US010555577B2

(12) United States Patent
Omoruyi

(10) Patent No.: US 10,555,577 B2
(45) Date of Patent: Feb. 11, 2020

(54) MASSAGING BOOT ASSEMBLY

(71) Applicant: Florence Omoruyi, Newark, NJ (US)

(72) Inventor: Florence Omoruyi, Newark, NJ (US)

( * ) Notice: Subject to any disclaimer, the term of this patent is extended or adjusted under 35 U.S.C. 154(b) by 115 days.

(21) Appl. No.: 15/806,430

(22) Filed: Nov. 8, 2017

(65) Prior Publication Data

US 2019/0133249 A1 May 9, 2019

(51) Int. Cl.

| | |
|---|---|
| ***A43B 3/00*** | (2006.01) |
| ***A43B 7/02*** | (2006.01) |
| ***A43B 7/04*** | (2006.01) |
| ***A43B 7/14*** | (2006.01) |
| ***A43B 3/02*** | (2006.01) |
| ***A43B 23/02*** | (2006.01) |

(52) U.S. Cl.

CPC ..... *A43B 7/146* (2013.01); *A43B 3/00* (2013.01); *A43B 3/0005* (2013.01); *A43B 3/02* (2013.01); *A43B 7/02* (2013.01); *A43B 7/04* (2013.01); *A43B 23/025* (2013.01)

(58) Field of Classification Search

CPC ..... A43B 3/0005; A43B 7/02; A43B 7/125; A43B 7/146; A43B 7/025; A43B 7/04

USPC ..... 36/2.6

See application file for complete search history.

(56) References Cited

U.S. PATENT DOCUMENTS 1,761,829 A * 6/1930 Heinemann ..... A43B 7/025 219/211
5,113,850 A * 5/1992 Larremore ..... A43B 3/00 601/136
5,464,654 A 11/1995 Mizuno
D374,550 S 10/1996 Huang
5,592,759 A * 1/1997 Cox ..... A43B 1/0054 36/136
5,902,743 A 5/1999 Luchansky et al.
5,956,866 A 9/1999 Spears
6,727,469 B1 * 4/2004 Parker ..... A43B 3/0005 219/211
7,152,345 B2 12/2006 Koenig
7,264,599 B1 * 9/2007 Milligan ..... A43B 3/0005 36/141
7,347,831 B2 3/2008 Chiu
7,487,606 B2 * 2/2009 Koo ..... A43B 1/0054 36/141
7,614,168 B1 11/2009 Zummer et al.
8,162,860 B1 * 4/2012 Ali ..... A61H 15/0078 36/141
8,322,055 B1 * 12/2012 Saint-Cyr ..... A61H 23/02 36/141
2004/0173220 A1 * 9/2004 Harry ..... A43B 3/0005 128/892
2005/0049653 A1 * 3/2005 Wang ..... A43B 1/0054 607/48
2015/0096203 A1 * 4/2015 Brown ..... A43B 7/146 36/136

(Continued)

*Primary Examiner* — Sharon M Prange

(57) ABSTRACT

A massaging boot assembly for massaging a foot includes a boot that may be worn on a foot. A massage unit is coupled to the boot and the massage unit selectively massages the foot when the boot is worn. The massage unit is selectively turned on and off. A heating unit is coupled to the boot such that the heating unit is in thermal communication with the boot. The heating unit is selectively turned on to selectively heat the foot thereby enhancing therapeutic relief of the foot.

9 Claims, 3 Drawing Sheets

(56) References Cited

U.S. PATENT DOCUMENTS

| | | | | |
|---|---|---|---|---|
| 2016/0183628 | A1* | 6/2016 | Usifoh | A43B 7/146<br>36/141 |
| 2016/0361230 | A1* | 12/2016 | Zahrieh | A61H 23/02 |
| 2017/0071283 | A1 | 3/2017 | James | |

* cited by examiner

MASSAGING BOOT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to boot devices and more particularly pertains to a new boot device for massaging a foot.

BRIEF SUMMARY OF THE INVENTION

An embodiment of the disclosure meets the needs presented above by generally comprising a boot that may be worn on a foot. A massage unit is coupled to the boot and the massage unit selectively massages the foot when the boot is worn. The massage unit is selectively turned on and off. A heating unit is coupled to the boot such that the heating unit is in thermal communication with the boot. The heating unit is selectively turned on to selectively heat the foot thereby enhancing therapeutic relief of the foot.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
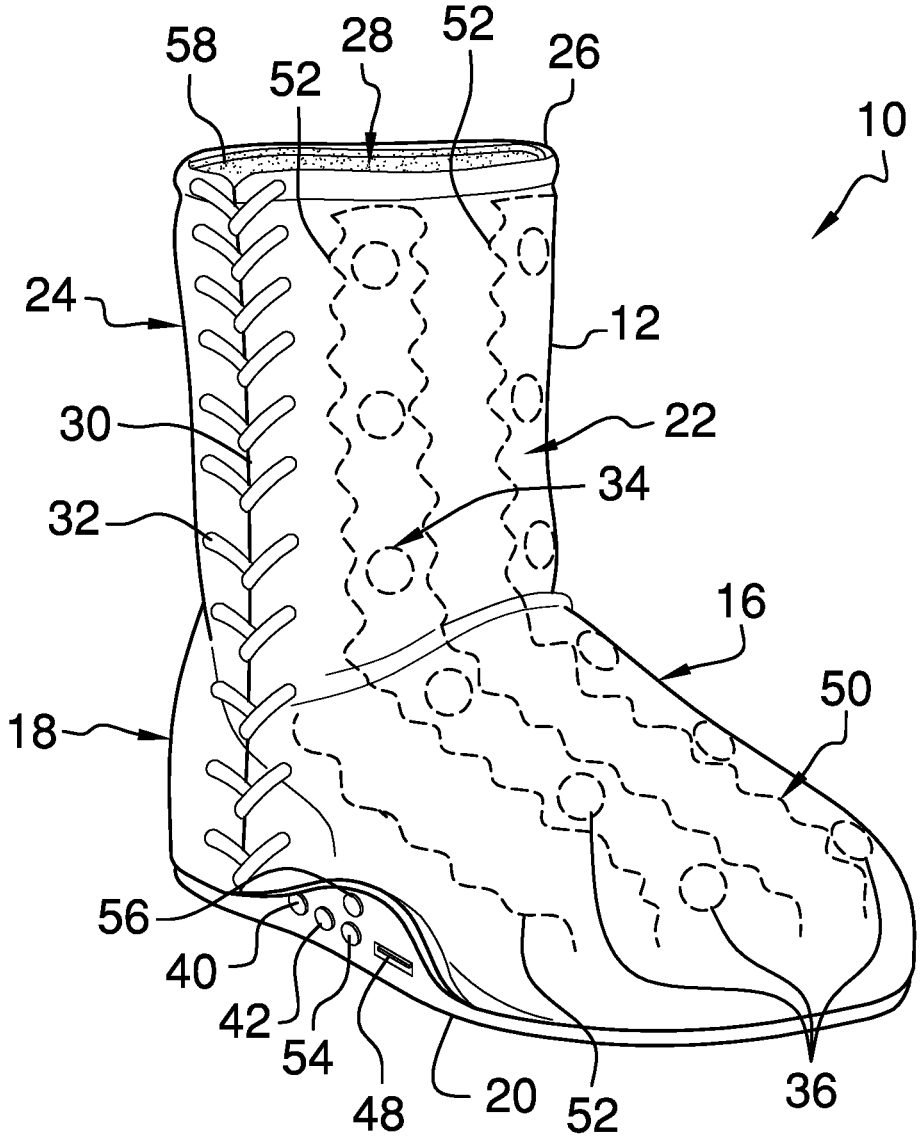
FIG. 1 is a perspective view of a massaging boot assembly according to an embodiment of the disclosure.
Figure 2:
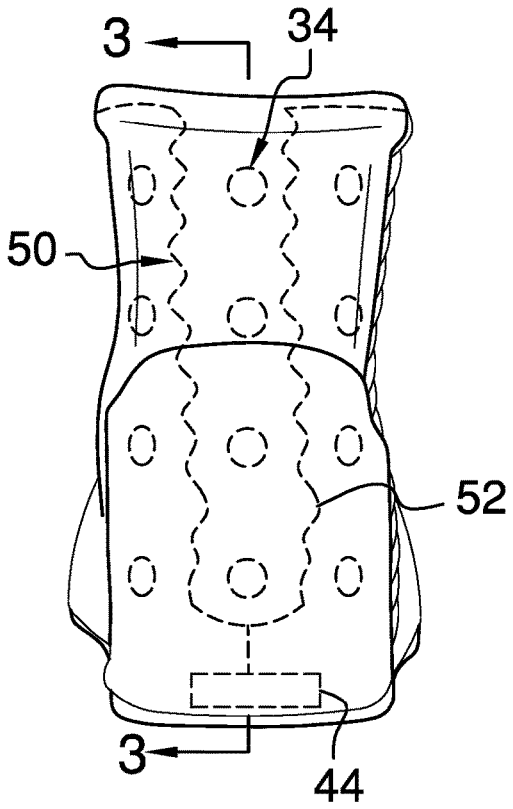
FIG. 2 is a back view of an embodiment of the disclosure.
Figure 3:
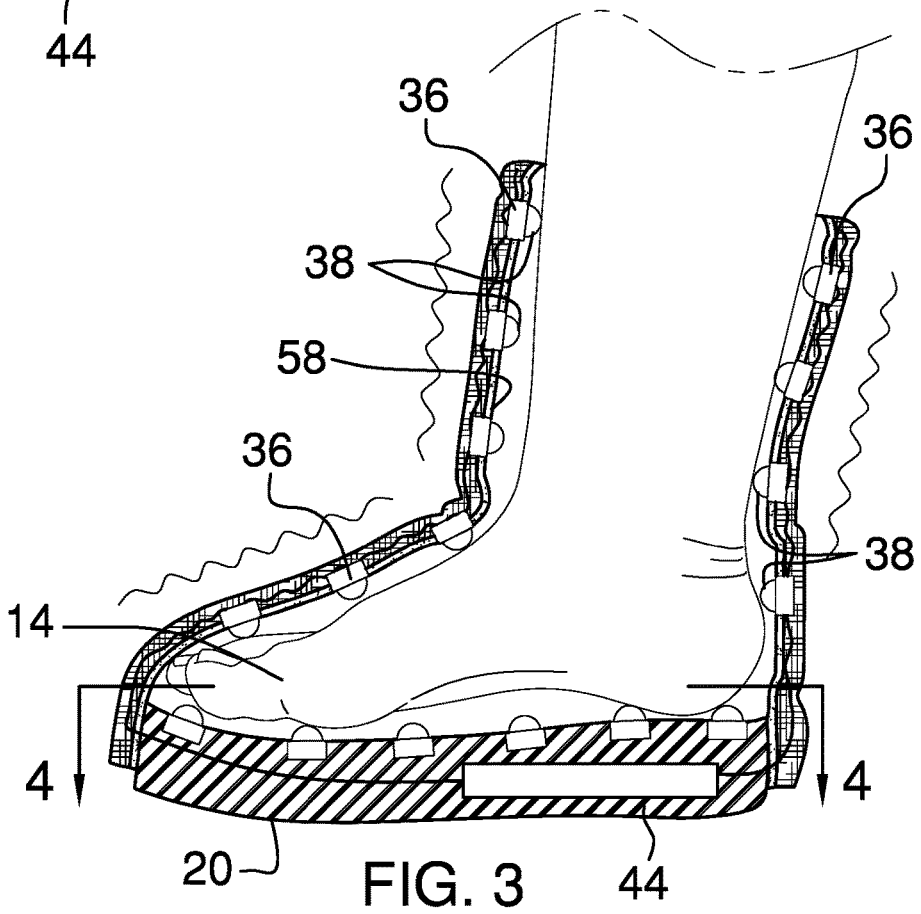
FIG. 3 is a cross sectional view taken along line 3-3 of FIG. 2 of an embodiment of the disclosure.
Figure 4:
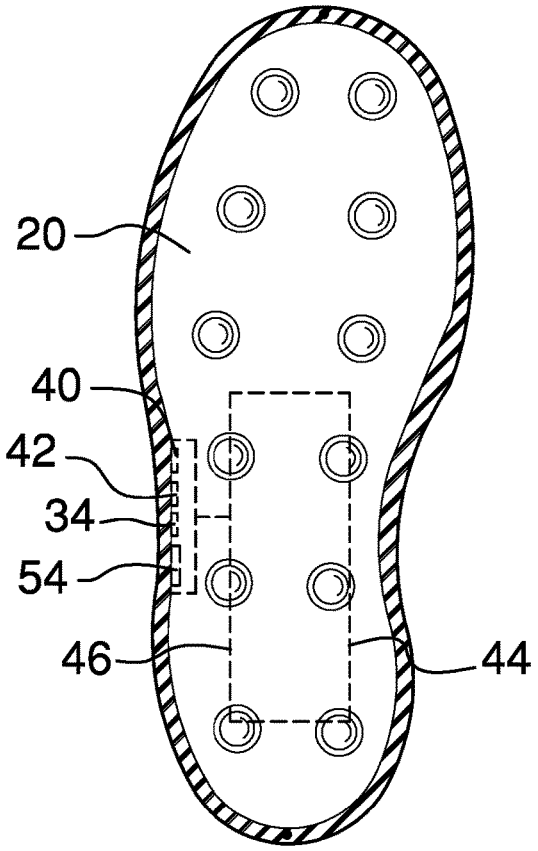
FIG. 4 is a cross sectional view taken along line 4-4 of FIG. 3 of an embodiment of the disclosure.
Figure 5:
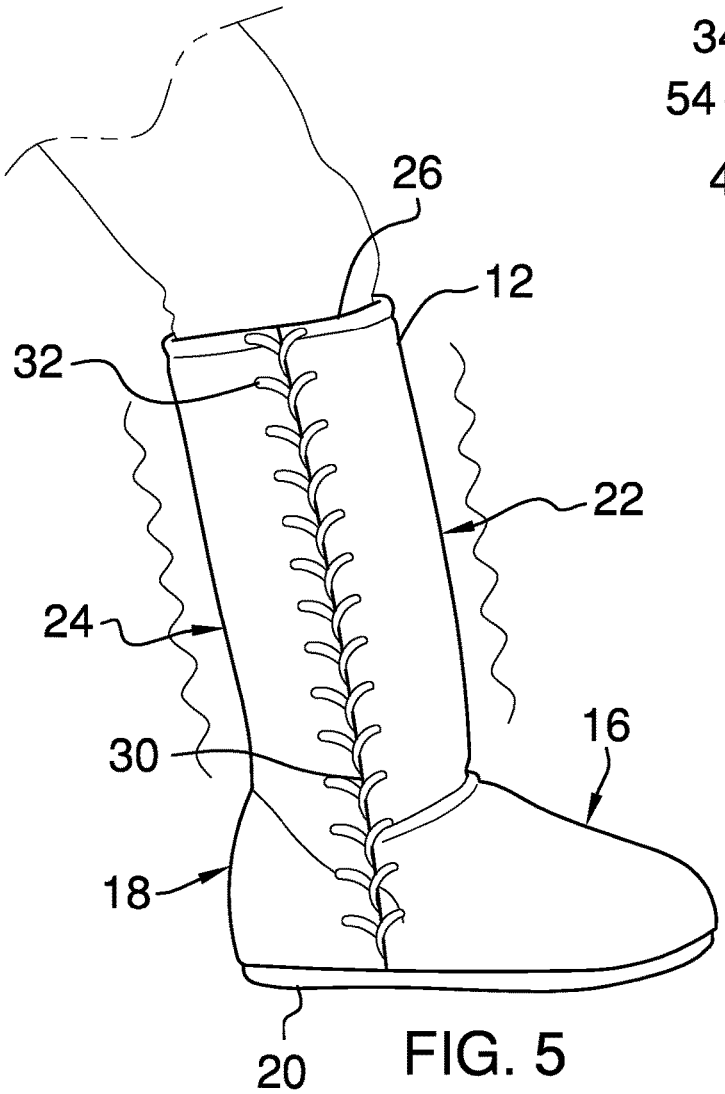
FIG. 5 is a perspective in-use view of an embodiment of the disclosure.

With reference now to the drawings, and in particular to FIGS. 1 through 5 thereof, a new boot device embodying the principles and concepts of an embodiment of the disclosure and generally designated by the reference numeral 10 will be described.

As best illustrated in FIGS. 1 through 5, the massaging boot assembly 10 generally comprises a boot 12 that may be worn on a foot 14. The boot 12 has a vamp 16, a counter 18, a sole 20, a front quarter 22 and a back quarter 24. Each of the front quarter 22 and the back quarter 24 has a distal edge 26 with respect to the sole 20 to define an opening 28 in the boot 12. The boot 12 has a cut 30 extending between the distal edge 26 and the sole 20 to divide the front quarter 22 from the back quarter 24. Moreover, the boot 12 may be comprised of a deformable material such as cotton/wool blend or the like. A string 32 or the like is laced between each of the front quarter 22 and the back quarter 24. The string 32 or the like is aligned with and is coextensive with the cut 30 such that the string 32 or the like selectively closes the cut 30 when the string 32 or the like is tightened.

A massage unit 34 is coupled to the boot 12 to massage the foot 14 when the boot 12 is worn. The massage unit 34 is selectively turned on and off. The massage unit 34 comprises a plurality of motors 36 and each of the motors 36 is positioned within the boot 12. The motors 36 are spaced apart from each other and are distributed along the vamp 16, the counter 18, the sole 20, the front quarter 22 and the back quarter 24. Thus, the motors 36 are aligned with all sides of the foot 14 when the boot 12 is worn. Each of the motors 36 is electrically coupled together to form an array of motors 36 and each of the motors 36 may be a multi-speed electrical motor or the like.

A plurality of balls 38 is provided and each of the balls 38 is coupled to an associated one of the motors 36. Each of the balls 38 is oscillated when the associated motor 36 is turned on thereby facilitating the balls 38 to massage the foot 14. Each of the balls 38 may be mechanically coupled to the associated motor 36 by any conventional means that facilitates the balls 38 to oscillate about an axis extending through the ball 38 and the associated motor 36. Moreover, each of the balls 38 may be comprised of a resiliently compressible material to enhance massaging the foot 14.

A first power button 40 is coupled the boot 12 and the power button is selectively manipulated. The first power button 40 is electrically coupled to the array of motors 36 such that the first power button 40 turns the array of motors 36 on and off. A speed button 42 is coupled to the boot 12 and the speed button 42 is selectively manipulated. The speed button 42 is electrically coupled to the array of motors 36 to actuate the array of motors 36 between a minimum speed and a maximum speed. In this way the intensity of oscillation with respect to the balls 38 may be adjusted.

A power supply 44 is positioned within the boot 12 and the power supply 44 is electrically coupled to the first power button 40. The power supply 44 comprises at least one battery 46 that is positioned within the sole 20. The at least one battery 46 is electrically coupled to the first power button 40. A charge port 48 is coupled to the sole 20 and the charge port 48 is selectively and electrically coupled to a power source. The charge port 48 is electrically coupled to the at least one battery 46 to charge the at least one battery 46. The charge port 48 may be a usb port or the like and the power source may be a rechargeable battery 46 charger or the like.

A heating unit 50 is coupled to the boot 12 such that the heating unit 50 is in thermal communication with the boot 12. The heating unit 50 is selectively turned on to selectively heat the foot 14 thereby enhancing therapeutic relief of the foot 14. The heating unit 50 comprises a plurality of heating elements 52 and each of the heating elements 52 is positioned within the boot 12. In this way each of the heating elements 52 is in thermal communication with the boot 12. The heating elements 52 are spaced apart from each other and are distributed on the vamp 16, the counter 18, the front quarter 22 and the back quarter 24. Additionally, each of the heating elements 52 may be electrical heating elements 52 or the like with an operational temperature ranging between 70.0 degrees Fahrenheit and 90.0 degrees Fahrenheit.

A second power button 54 is coupled to the boot 12 and the second power button 54 is selectively manipulated. The second power button 54 is electrically coupled between the power supply 44 and each of the heating elements 52 to turn the heating elements 52 on and off. A temperature button 56 is coupled the boot 12 and the temperature button 56 is selectively manipulated. The temperature button 56 is electrically coupled each of the heating elements 52 to actuate the plurality of heating elements 52 between a minimum temperature and a maximum temperature. A liner 58 may be provided and the liner 58 may be positioned in the boot 12. The liner 58 may be comprised of a thermally insulating material to enhance comfort when the boot 12 is worn.

In use, the boot 12 is worn on the foot 14 and the string 32 is tightened to tighten the boot 12. The first power button 40 is manipulated to turn the motors 36 on for massaging the foot 14. Additionally, the speed button 42 is manipulated to adjust an intensity of the motors 36. The second power button 54 is manipulated to turn the heating elements 52 on. In this way the foot 14 is heated for relief of muscle pain and the like. The temperature button 56 is manipulated to adjust the temperature of the heating elements 52. The massage unit 34 and the heating unit 50 may each be turned on independently and simultaneously with respect to each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A massaging boot assembly being configured to massage a foot, said assembly comprising:

a boot being configured to be worn on a foot, said boot having a vamp, a counter, a sole, a front quarter and a back quarter, each of said front quarter and said back quarter having a distal edge with respect to said sole to define an opening in the said boot, said boot having a cut extending between said distal edge and said sole to divide said front quarter from said back quarter;

a string being laced between each of said front quarter and said back quarter, said string being aligned with and being coextensive with said cut such that said string selectively closes said cut when said string is tightened;

a massage unit being coupled to said boot wherein said massage unit is configured to massage the foot when said boot is worn, said massage unit being selectively turned on and off, said massage unit comprising a plurality of motors, each of said motors being positioned within said boot, said motors being spaced apart from each other and being distributed along said vamp, said counter, said sole, said front quarter and said back quarter, each of said motors being electrically coupled together to form an array of motors;

a first power button being coupled to said boot wherein said power button is configured to be manipulated, said power button being electrically coupled to said array of motors such that said power button turns said array of motors on and off; and a heating unit being coupled to said boot such that said heating unit is in thermal communication with said boot, said heating unit being selectively turned on wherein said heating unit is configured to selectively heat the foot thereby enhancing therapeutic relief of the foot, said heating unit comprising a plurality of heating elements, each of said heating elements being positioned within said boot such that each of said heating elements is in thermal communication with said boot, said heating elements being spaced apart from each other and being distributed on said vamp, said counter, said front quarter and said back quarter.

2. The assembly according to claim 1, further comprising a plurality of balls, each of said balls being coupled to an associated one of said motors such that each of said balls is oscillated when said associated motor is turned on wherein each of said balls is configured to massage the foot.

3. The assembly according to claim 2, further comprising a speed button being coupled to said boot wherein said speed button is configured to be manipulated, said speed button being electrically coupled to said array of motors, said speed button actuating said array of motors between a minimum speed and a maximum speed thereby adjusting an intensity of oscillation with respect to said balls.

4. The assembly according to claim 1, further comprising a power supply being positioned within said boot, said power supply being electrically coupled to said first power button.

5. The assembly according to claim 4, wherein said power supply comprises at least one battery being positioned within said sole, said at least one battery being electrically coupled to said first power button.

6. The assembly according to claim 5, further comprising a charge port being coupled to said sole wherein said charge port is configured to be electrically coupled to a power source, said charge port being electrically coupled to said at least one battery to charge said at least one battery.

7. The assembly according to claim 1, further comprising:

a power supply being coupled to said boot; and a second power button being coupled to said boot wherein said second power button is configured to be manipulated, said second power button being electrically coupled between said power supply and each of said heating elements such that said second power button turns said heating elements on and off.

8. The assembly according to claim 7, further comprising a temperature button being coupled to said boot wherein said temperature button is configured to be manipulated, said temperature button being electrically coupled to each of said heating elements such that said temperature button actuates said plurality of heating elements between a minimum temperature and a maximum temperature.

9. A massaging boot assembly being configured to massage a foot, said assembly comprising:

a boot being configured to be worn on a foot, said boot having a vamp, a counter, a sole, a front quarter and a back quarter, each of said front quarter and said back quarter having a distal edge with respect to said sole to define an opening in the said boot, said boot having a cut extending between said distal edge and said sole to divide said front quarter from said back quarter;

a string being laced between each of said front quarter and said back quarter, said string being aligned with and being coextensive with said cut such that said string selectively closes said cut when said string is tightened;

a massage unit being coupled to said boot wherein said massage unit is configured to massage the foot when said boot is worn, said massage unit being selectively turned on and off, said massage unit comprising:

a plurality of motors, each of said motors being positioned within said boot, said motors being spaced apart from each other and being distributed along said vamp, said counter, said sole, said front quarter and said back quarter, each of said motors being electrically coupled together to form an array of motors, a plurality of balls, each of said balls being coupled to an associated one of said motors such that each of said balls is oscillated when said associated motor is turned on wherein each of said balls is configured to massage the foot, a first power button being coupled to said boot wherein said power button is configured to be manipulated, said power button being electrically coupled to said array of motors such that said power button turns said array of motors on and off, a speed button being coupled to said boot wherein said speed button is configured to be manipulated, said speed button being electrically coupled to said array of motors, said speed button actuating said array of motors between a minimum speed and a maximum speed thereby adjusting an intensity of oscillation with respect to said balls, and a power supply being positioned within said boot, said power supply being electrically coupled to said first power button, said power supply comprising:

at least one battery being positioned within said sole, said at least one battery being electrically coupled to said first power button, and a charge port being coupled to said sole wherein said charge port is configured to be electrically coupled to a power source, said charge port being electrically coupled to said at least one battery to charge said at least one battery; and a heating unit being coupled to said boot such that said heating unit is in thermal communication with said boot, said heating unit being selectively turned on wherein said heating unit is configured to selectively heat the foot thereby enhancing therapeutic relief of the foot, said heating unit comprising:

a plurality of heating elements, each of said heating elements being positioned within said boot such that each of said heating elements is in thermal communication with said boot, said heating elements being spaced apart from each other and being distributed on said vamp, said counter said front quarter and said back quarter, a second power button being coupled to said boot wherein said second power button is configured to be manipulated, said second power button being electrically coupled between said power supply and each of said heating elements such that said second power button turns said heating elements on and off, and a temperature button being coupled to said boot wherein said temperature button is configured to be manipulated, said temperature button being electrically coupled each of said heating elements such that said temperature button actuates said plurality of heating elements between a minimum temperature and a maximum temperature.

* * * * *